US009273442B2

(12) United States Patent
Barrett et al.

(10) Patent No.: US 9,273,442 B2
(45) Date of Patent: Mar. 1, 2016

(54) COMPOSITE SELF-DRILLING SOIL NAIL AND METHOD

(75) Inventors: Colby Barrett, Fruita, CO (US); Timothy Allen Ruckman, Phoenix, AZ (US)

(73) Assignee: R&B Leasing, LLC, Fruita, CO (US)

( * ) Notice: Subject to any disclaimer, the term of this patent is extended or adjusted under 35 U.S.C. 154(b) by 1299 days.

(21) Appl. No.: 12/646,672

(22) Filed: Dec. 23, 2009

(65) Prior Publication Data

US 2010/0166506 A1 Jul. 1, 2010

Related U.S. Application Data

(63) Continuation-in-part of application No. 11/693,584, filed on Mar. 29, 2007, now abandoned, which is a continuation-in-part of application No. 11/460,317, filed on Jul. 27, 2006, now Pat. No. 7,338,233, which is a continuation-in-part of application No. 10/741,951, filed on Dec. 18, 2003, now Pat. No. 7,226,247.

(51) Int. Cl.
*E21D 20/00* (2006.01)
*E02D 5/80* (2006.01)

(52) U.S. Cl.
CPC ..... *E02D 5/80* (2013.01)

(58) Field of Classification Search
CPC ..... E02D 5/80
USPC ..... 405/229, 231, 251, 253, 258.1, 258.2, 405/259.5, 262, 272, 288, 302.1, 302.4
See application file for complete search history.

(56) References Cited

U.S. PATENT DOCUMENTS

| | | | |
|---|---|---|---|
| 250,134 | A | 11/1881 | Coy |
| 332,359 | A | 12/1885 | Paine |
| 571,225 | A | 11/1896 | Geisel |

(Continued)

FOREIGN PATENT DOCUMENTS

| | | |
|---|---|---|
| CN | 2905900 | 5/2007 |
| EP | 0307291 | 3/1989 |

(Continued)

OTHER PUBLICATIONS

FiReP® "Rebar Technology—Durability for the Future," undated, pp. 1-27.

(Continued)

*Primary Examiner* — Tara M. Pinnock
(74) *Attorney, Agent, or Firm* — Sheridan Ross P.C.

(57) ABSTRACT

A subsurface support comprises a soil nail having an outer member and an inner member placed within the outer member. By crimping the outer member or by use of an insert installed between the inner and outer members, a uniform spaced relationship can be maintained between the inner and outer members. In another embodiment, the support is made of composite construction materials, and the support has a self-drilling capability. The outer member may be made from fiberglass, and a metallic drill bit is secured to a distal end of the soil nail. The inner member is preferably steel. In yet another embodiment, the support includes a plurality of outer threaded members with adjacent outer members interconnected by a threaded coupler. A continuous inner member may be placed through the outer members. The inner member may be threaded for attachment to the outer members that also have internal matching threads.

5 Claims, 13 Drawing Sheets

(56) References Cited

U.S. PATENT DOCUMENTS

| | | | | |
|---|---|---|---|---|
| 1,163,981 | A | 12/1915 | Dodds | |
| 1,188,914 | A | 6/1916 | Dodds | |
| 1,271,151 | A | 7/1918 | Frauenheim | |
| 1,597,573 | A | 8/1926 | Blue | |
| 2,314,897 | A | 3/1943 | Purinton | |
| 2,667,037 | A | 1/1954 | Thomas et al. | |
| 3,047,036 | A | 7/1962 | Waltermire | |
| 3,060,694 | A | 10/1962 | Holmes | |
| 3,226,933 | A | 1/1966 | White | |
| 3,286,416 | A | 11/1966 | Ashworth | |
| 3,371,494 | A | 3/1968 | Lagerstrom | |
| 3,469,491 | A | 9/1969 | Munsey | |
| 3,487,646 | A | 1/1970 | Gatien | |
| 3,490,242 | A | 1/1970 | Schnabel | |
| 3,491,497 | A | 1/1970 | Bauer | |
| 3,496,729 | A | 2/1970 | Pleuger | |
| 3,680,274 | A | 8/1972 | Deike | |
| 3,753,354 | A * | 8/1973 | Bauer | 405/259.5 |
| 3,807,182 | A * | 4/1974 | Schnabel, Jr. | 405/131 |
| 3,808,624 | A | 5/1974 | Barkdull, Jr. | |
| 3,893,274 | A | 7/1975 | Salisbury | |
| 3,971,177 | A | 7/1976 | Endo | |
| 3,979,918 | A | 9/1976 | Vidler | |
| 3,981,038 | A | 9/1976 | Vidal | |
| 3,999,391 | A | 12/1976 | Meredith | |
| 4,024,719 | A | 5/1977 | Risseeuw | |
| 4,124,983 | A * | 11/1978 | Weatherby | 405/259.5 |
| 4,132,080 | A | 1/1979 | Hansen | |
| 4,181,995 | A | 1/1980 | Zur | |
| 4,247,225 | A | 1/1981 | Chickini et al. | |
| 4,253,781 | A | 3/1981 | Fischer et al. | |
| 4,274,762 | A | 6/1981 | Johnson | |
| 4,284,379 | A | 8/1981 | Chaiko | |
| 4,302,131 | A * | 11/1981 | Brown | 405/259.5 |
| 4,323,657 | A | 4/1982 | Mazanek et al. | |
| 4,360,292 | A | 11/1982 | Keeler et al. | |
| 4,386,877 | A | 6/1983 | McDowell, Jr. | |
| 4,397,589 | A * | 8/1983 | Darroussin et al. | 405/259.5 |
| 4,479,748 | A | 10/1984 | Uhlmann | |
| 4,490,074 | A | 12/1984 | Chaiko | |
| 4,502,818 | A | 3/1985 | Elders | |
| 4,564,313 | A | 1/1986 | Niswander et al. | |
| 4,564,967 | A | 1/1986 | Vidal | |
| 4,571,124 | A | 2/1986 | Matsui et al. | |
| 4,584,247 | A | 4/1986 | Mulholland | |
| 4,607,984 | A * | 8/1986 | Cassidy | 405/259.6 |
| 4,610,568 | A | 9/1986 | Koerner | |
| 4,619,559 | A | 10/1986 | Norris | |
| 4,636,115 | A | 1/1987 | Davis et al. | |
| 4,648,753 | A * | 3/1987 | Stephan | 405/259.5 |
| 4,666,345 | A | 5/1987 | Seegmiller | |
| 4,712,957 | A | 12/1987 | Edwards et al. | |
| 4,728,225 | A | 3/1988 | Brandl et al. | |
| 4,856,952 | A | 8/1989 | Shaw | |
| 4,940,365 | A | 7/1990 | Rozanc | |
| 4,952,097 | A | 8/1990 | Kulchin | |
| 4,954,017 | A | 9/1990 | Davis et al. | |
| 4,993,872 | A | 2/1991 | Lockwood | |
| 5,017,047 | A | 5/1991 | Myles et al. | |
| 5,044,831 | A * | 9/1991 | Myles et al. | 405/259.1 |
| 5,054,146 | A | 10/1991 | Wiesenfeld et al. | |
| 5,076,734 | A * | 12/1991 | Hipkins, Sr. | 405/259.5 |
| 5,127,783 | A | 7/1992 | Moghe et al. | |
| 5,192,168 | A | 3/1993 | Massarsch et al. | |
| 5,192,169 | A | 3/1993 | Landsberg | |
| 5,222,850 | A | 6/1993 | Medal | |
| 5,234,291 | A | 8/1993 | Swemmer | |
| 5,263,291 | A * | 11/1993 | Knight | 52/223.13 |
| 5,273,377 | A | 12/1993 | Taylor | |
| 5,297,900 | A | 3/1994 | Witzand | |
| 5,472,296 | A | 12/1995 | Von Allmen et al. | |
| 5,494,378 | A | 2/1996 | Hanson | |
| 5,542,785 | A | 8/1996 | Cloud | |
| 5,549,418 | A | 8/1996 | Devine et al. | |
| 5,551,810 | A | 9/1996 | Franceski et al. | |
| 5,588,784 | A | 12/1996 | Brandl et al. | |
| 5,634,752 | A | 6/1997 | Haage et al. | |
| 5,647,709 | A | 7/1997 | Hein et al. | |
| 5,649,790 | A | 7/1997 | Mergen et al. | |
| 5,653,557 | A | 8/1997 | Gruber | |
| 5,669,199 | A | 9/1997 | Ludwig et al. | |
| 5,688,077 | A | 11/1997 | Kynoch | |
| 5,709,332 | A | 1/1998 | Coop | |
| 5,713,162 | A | 2/1998 | Gallo et al. | |
| 5,713,701 | A | 2/1998 | Marshall | |
| 5,730,565 | A | 3/1998 | Hein et al. | |
| 5,829,922 | A * | 11/1998 | Calandra et al. | 405/302.2 |
| 5,864,993 | A | 2/1999 | Wells | |
| 5,890,843 | A * | 4/1999 | Bastick et al. | 405/259.1 |
| 5,919,005 | A | 7/1999 | Rupiper | |
| 5,921,715 | A * | 7/1999 | Rainey | 405/262 |
| 5,927,905 | A | 7/1999 | Van Halteren | |
| 5,931,606 | A | 8/1999 | Karlsen | |
| 5,934,836 | A | 8/1999 | Rupiper et al. | |
| 5,984,588 | A | 11/1999 | Ferrari | |
| 6,280,120 | B1 | 8/2001 | Okamoto et al. | |
| 6,299,386 | B1 | 10/2001 | Byrne et al. | |
| 6,514,012 | B2 * | 2/2003 | Gregory et al. | 405/230 |
| 6,524,027 | B1 | 2/2003 | Fabius | |
| 6,533,498 | B1 | 3/2003 | Quin | |
| 6,565,288 | B1 * | 5/2003 | McCallion | 405/259.5 |
| 6,652,195 | B2 | 11/2003 | Vickars et al. | |
| 6,742,976 | B2 | 6/2004 | Groll | |
| 6,745,421 | B2 | 6/2004 | Barrett et al. | |
| 6,776,242 | B1 | 8/2004 | Cunningham | |
| 6,796,745 | B2 | 9/2004 | Kulchin | |
| 6,820,379 | B1 | 11/2004 | Krinner et al. | |
| 6,874,975 | B2 | 4/2005 | Hilfiker et al. | |
| 6,890,127 | B1 | 5/2005 | Barrett et al. | |
| 6,926,186 | B2 | 8/2005 | Wells | |
| 6,931,805 | B2 * | 8/2005 | Gregory et al. | 52/296 |
| 7,025,016 | B1 | 4/2006 | Landes | |
| 7,037,058 | B2 | 5/2006 | Fergusson | |
| 7,040,850 | B2 | 5/2006 | Gaudron | |
| 7,226,247 | B2 | 6/2007 | Barrett et al. | |
| 7,309,199 | B2 | 12/2007 | Ayrle | |
| 7,338,233 | B2 | 3/2008 | Barrett et al. | |
| 7,377,725 | B2 | 5/2008 | Cammack | |
| 7,384,217 | B1 | 6/2008 | Barrett et al. | |
| 7,478,986 | B2 | 1/2009 | Bushell et al. | |
| 7,507,048 | B2 | 3/2009 | Colarusso et al. | |
| 7,513,728 | B1 | 4/2009 | Seace | |
| 7,736,738 | B2 * | 6/2010 | Simmons et al. | 428/375 |
| 2001/0046418 | A1 * | 11/2001 | Lay | 405/259.4 |
| 2002/0108348 | A1 * | 8/2002 | Yukimoto et al. | 52/747.12 |
| 2003/0099518 | A1 * | 5/2003 | Barley | 405/259.1 |
| 2004/0031214 | A1 | 2/2004 | Fong et al. | |
| 2004/0109729 | A1 | 6/2004 | Hilfiker et al. | |
| 2004/0161305 | A1 | 8/2004 | Simmons et al. | |
| 2004/0202512 | A1 | 10/2004 | Smith | |
| 2005/0097849 | A1 | 5/2005 | Hayes | |
| 2007/0172315 | A1 | 7/2007 | Barrett et al. | |
| 2007/0292231 | A1 | 12/2007 | Boot et al. | |
| 2008/0193225 | A1 | 8/2008 | Melegari | |
| 2010/0054866 | A1 | 3/2010 | Barrett et al. | |
| 2010/0166505 | A1 | 7/2010 | Barrett et al. | |

FOREIGN PATENT DOCUMENTS

| | | | |
|---|---|---|---|
| GB | 002289078 | A | 11/1995 |
| JP | 403257216 | A | 11/1991 |
| JP | 408189035 | A | 7/1996 |
| JP | 02004027813 | A | 1/2004 |
| KR | 10-2007-0061487 | | 6/2007 |
| WO | WO03035988 | A1 * | 5/2003 |
| WO | WO2005098165 | A1 * | 10/2005 |

OTHER PUBLICATIONS

Brochure, "Composite Self-Drilling Soil Nails," Weldgrip Geotechnical, undated, 2 pages.

Poly(Vinyl Chloride) Copyright 1995, 1996, available at http://www.psrc.usm.edu/macrog/pvc.htm, accessed on Oct. 19, 2004, 3 pages.

(56) References Cited

OTHER PUBLICATIONS

Colorado Department of Transportation Bridge Design Manual Section Seven, Substructures (Sections 7.1-7.3), Nov. 2, 1987, 11 pages.

Colorado DOT Demonstration "The Soil Nail Launcher, Where Speed, Cost and the Environment are Important," available at http://www.soilnaillauncher.com, 1 page.

Official Action for Canadian Patent Application No. 2,591,617, dated Mar. 20, 2009.

Official Action for Canadian Patent Application No. 2,591,617, dated Jan. 21, 2010.

Official Action for Canadian Patent Application No. 2,591,617, dated May 25, 2010.

Official Action for Australian Patent Application No. 583117, dated Feb. 9, 2010.

Official Action for Australian Patent Application No. 583117, dated Mar. 23, 2010.

Official Action for Australian Patent Application No. 586911, dated Jul. 27, 2010.

* cited by examiner

COMPOSITE SELF-DRILLING SOIL NAIL AND METHOD

CROSS REFERENCE TO RELATED APPLICATIONS

This application is a continuation-in-part application of co-pending U.S. application Ser. No. 11/693,584, filed on Mar. 29, 2007 entitled "Method and Apparatus for Creating Soil or Rock Subsurface Support", which is a continuation-in-part application of co-pending U.S. application Ser. No. 11/460,317, filed on Jul. 27, 2006, entitled "Method and Apparatus for Creating Soil or Rock Subsurface Support", which is a continuation-in-part of co-pending U.S. application Ser. No. 10/741,951, filed on Dec. 18, 2003, entitled "Method and Apparatus for Creating Soil or Rock Subsurface Support", the disclosures of these applications being hereby incorporated by reference herein in their entirety.

FIELD OF THE INVENTION

The present invention relates generally to subsurface supports placed in the ground, and more particularly, to a method and apparatus for creating soil or rock subsurface supports that can be used in multiple applications to include support for excavations as a passive soil nail in tension, bending and/or shear, support to stabilize sloping terrain as a tieback in tension, support for an above ground structure as a micropile in compression and/or shear, or support for an above ground structure as an anchor in tension. A preferred embodiment of the invention includes a composite self-drilling soil nail installed by drilling.

BACKGROUND OF THE INVENTION

In the construction of buildings, bridges, and other man-made structures, it is well known to place passive supports such as footers, piles, and other subsurface supports for supporting such man-made structures. These types of supports are passive because the earth around the subsurface support must first shift or move to mobilize the available tensile, bending, or shear capacities.

One particular problem associated with subsurface supports which may be made of iron, steel, or other metals is that over time, corrosion takes place which ultimately degrades the ability of the support to provide designed support for an overlying structure.

In addition to providing the above-mentioned subsurface supports, it is also known to provide ground strengthening by driving elongate reinforcing members, referred to as soil nails, into the ground in an array thus improving the bulk properties of the ground. The soil nails themselves are not used for direct support of an overlying structure; rather, the soil nails are simply used to prevent shifting or other undesirable properties or characteristics of a particular geological formation that is built upon.

In some cases, the earth surrounding or near a man made structure becomes unstable and requires active support, such as by a tieback. Tiebacks are pre-tensioned subsurface supports that are used to restrain any movement of surrounding soil and rock. Tiebacks are similar to passive soil nails in construction, and can be emplaced in a similar fashion as a soil nail. More recently, soil nails and tiebacks have also been used to provide temporary and permanent excavation support and slope stabilization.

The U.S. Pat. No. 5,044,831 discloses a method of soil nailing wherein a soil nail is placed in the ground by being fired from a barrel of a launcher. The soil nail is loaded into the barrel, and pressurized gas emitted from the barrel forces the soil nail into the ground to a desired depth. One advantage of using a soil nail launcher is that the soil nails can be emplaced with a minimum amount of labor and equipment thereby minimizing environmental impacts as well as providing a simple and economical means of strengthening the ground. Drilling is the traditional way to install soil nails, tiebacks, and anchors.

Although there are a multitude of subsurface supports and methods by which subsurface supports can be emplaced, there is still a need for simple and effective subsurface supports and an environmentally friendly manner in which subsurface supports are emplaced.

SUMMARY OF THE INVENTION

In accordance with the present invention, a method and apparatus are provided to create a subsurface support device that is placed in the ground. In a first embodiment of the invention, the support device of the present invention has many potential uses. In one use, this support device can be used as a passive soil nail. In another use, this support device of the present invention can be used as an active tieback in tension. More generally, for use as a tieback, this support device can also be referred to as a soil or rock inclusion. The term inclusion refers to the ability of the support device to increase the tensile capacity of the rock and soil. In yet another use, this support device can be used as a micropile in compression, bending and shear. This support device, when acting as a micropile, can be physically connected to an overlying structure. In yet another use, this support device can be used as an anchor in tension. For example, this support may be tensioned as by a cable that interconnects the support to a man made structure.

Once emplaced, this support device includes a protective outer member or tube, an inner support member, and a stabilizing mixture, preferably in the form of grout, cement, resin, or combinations thereof which fixes the inner support member within the outer protective member. The stabilizing mixture may also be referred to as a cementious mixture. The outer protective member supports the opening into the native rock and soil, and acts as a housing for the cement us mixture. As discussed further below, the outer member may be perforated thereby allowing the cement us material to exit the perforations and increase the overall tensile and compressive contribution of the support device. The outer protective member also provides a barrier to prevent water or other corrosive materials from contacting the inner support member. The inner support member provides the design tensile and compressive strength of the support. The inner support member may protrude a desired distance above the outer member to connect to an overlying structure to provide support in any desired manner to include bearing/compression, tension, and/or shear. The diameter and length of the outer member and inner member can be selected to provide the necessary support. The outer member and stabilizing mixture provide strengthening support to the inner member. For example, in compression, the forces are transmitted from the inner support member directly to the stabilizing mixture and the outer member. In tension, forces are also transmitted to the stabilizing mixture and the outer member thereby greatly increasing the force necessary to dislodge or pull out the inner member. The method by which the outer member of the subsurface support is emplaced in the ground is preferably by a launching mechanism, such as that disclosed in the U.S. Pat. No. 5,044,831.

In another embodiment of the present invention, the support device is in the form of an improved soil nail including a fiberglass body and a metal tip. The metal tip is preferably made from a single piece of metal, such as a machined ingot of hardened steel. The tip comprises a contacting portion or stinger that makes contact with the ground when emplaced, and a proximal base portion that is received within an opening in the distal end of the fiberglass body thus allowing the tip to be attached to the fiberglass body. The base portion may be attached by a compression fit within the opening of the body and/or may be secured by an appropriate bonding agent, such urethane glue. The size and dimensions of the soil nail can be modified for the intended purpose of use. One common size acceptable for use in many soil stabilization efforts includes a fiberglass body of twenty feet in length and a contacting portion of the metal tip extending approximately six inches in length from the distal end of the fiberglass body. For those applications in which a shorter body is required, the same tip construction can be used, and the length of the body can simply be shortened. Unlike most prior art soil nails, the soil nail of the present invention has a tubular shaped body without projections which allows the soil nail to be emplaced by the soil nail launcher disclosed in the U.S. Pat. No. 5,044,831. The use of a soil nail with a fiberglass body in conjunction with a metal tip provides many advantages. The fiberglass body provides a more cost effective solution than traditional soil nails that are just made of metal. The fiberglass body also is highly resistant to corrosion, even more so than many metal soil nails within corrosion treated surfaces. The weight of the soil nail of the present invention is also less than a metal soil nail, allowing it to achieve greater velocity when emplaced by a soil nail launcher, thus enhancing its ability to penetrate the ground. The strength of the soil nail is not compromised because the fiberglass has adequate strength, and has a greater elastic limit as compared to many metal soil nails enabling the nail to handle even greater tensile and shear loads. Although the soil nail has a relatively smooth outer surface allowing it to be emplaced by a launcher, the surface characteristics of the fiberglass provide excellent adhesion with soil. Additionally, the stinger can be especially designed to handle particular soil or rock formations without having to modify the body of the soil nail. For example, in more dense soil or rock formations, the stinger shape can be modified prior to assembly with the body thus making the soil nail more adaptable for many uses.

In another preferred embodiment of the present invention, a self-centralizing soil nail is provided. This self-centralizing feature enables the inner member or inner bar to be centralized within the outer member. The inner member maintains a uniform concentric relationship wherein the inner member is uniformly spaced from the inner surface of the outer member. This feature is achieved by crimping the outer member at selected locations along the length of the outer member thereby narrowing the inner diameter of the outer member, but maintaining an opening in the outer member large enough for passage of the inner member. The outer member is crimped so that the inner member is centered in the opening of the outer member and, the space between the outer surface of the inner member and the interior surface of the outer member is substantially uniform. Placing the inner member in this centralized relationship increases the capacity of the soil nail both in tension and compression. If the soil nail is not centered and makes contact with the interior surface of the outer member, the inner member is subject to corrosion. Additionally, if the inner member is spaced too closely to the interior surface of the outer member, there may be small voids or spaces that do not completely fill with cementious material and/or the cementious may have a very small thickness which is more susceptible to being fractured. The narrowing of the diameter of the outer member achieves natural centering of the inner member without having to make an outer member of a more complex construction.

In yet another embodiment of the present invention, this self-centering feature can be achieved by use of one or more self-centralizing elements that may be installed within the outer member. These self-centralizing elements may be in the form of inserts or spacers that have an outer diameter sized to frictionally engage the inner diameter of the outer member. The centralizing element has an inner diameter that is sized to frictionally receive the inner member thereby holding the inner member. The centralizing elements may be located at the proximal and distal ends of the outer member, with one or more centralizing elements also being placed intermediate between the proximate and distal ends.

In yet another embodiment, the self-centralizing feature of the present invention may be incorporated into a soil nail that is installed by drilling the soil nail into the ground. This self-drilling soil nail includes a drilling bit secured to the distal end of the soil nail.

In yet another preferred embodiment of the present invention, a composite self-drilling soil nail is provided in which the soil nail is installed by drilling. The soil nail is self-installing by inclusion of a drill tip attached to the distal end thereof. This soil nail more specifically comprises an outer member or tubular member having a threaded outer surface with a hollow opening or bore extending therethrough, and the hollow bore also being threaded. Preferably, the outer member is made of a material such as fiberglass. If it is necessary to extend a length of the outer member, an outer coupler may be used to join the distal end of one outer member with proximal end of an abutting outer member. The outer coupler is a tubular member itself, having internal threads which are threaded in an engagement with the abutting ends of the outer members. A threaded inner member is placed through the threaded bore of the outer tubular member by threaded engagement between threads on the inner bore and external threads on the outer surface of the inner member. As mentioned, the drill tip is secured to the most distal end of the soil nail enabling the soil nail to be self-drilled. The proximal end of the soil nail receives a bearing plate sized to hold or bear against the specific geological formation being held by the soil nail. An outer nut is threaded over the outer member and in engagement against the bearing plate. An inner nut is threaded over the inner member that has an end protruding beyond the adjacent end of the outer member, and the inner nut is tightened against the outer nut. The use of the threaded inner member enhances the strength of the soil nail, particularly when using fiberglass as the outer member, and also when fiberglass sections are to be joined for extending a length of the soil nail. The use of steel couplers improves the strength of the joint between the outer members; however, metallic couplers will corrode over time. The use of the inner member provides more permanent tensile and compressive capacity to the overall soil nail, and also helps to compensate for weakening of the metallic coupler over time. If fiberglass couplers are used, the joint between the outer tubular members is relatively weak, but the inner bar again greatly enhances the bearing capacity of the soil nail. The use of two holding nuts as opposed to a single nut against the bearing plate further provides strength to the system.

The primary problem with use of fiberglass is that fiberglass has a very low shear resistance. Therefore, creating threads on a fiberglass member will result in a very weak connection at that threaded location, which clearly limits the application of fiberglass soil nails when they must be threaded. One solution provided by the present invention is the use of the inner member which overcomes any deficiencies with respect to a threaded fiberglass member.

In another aspect of the invention, various embodiments are provided with surface irregularities or asperities that increase the pull-out capacity of the soil nail. In one embodiment, the surface asperities include protrusions formed on the outer surface of the soil nail. In another embodiment, the surface asperities may include indentations. These surface asperities may be used in combinations. In another aspect, the surface asperities are created by a galvanization process in which the outer tube or member is subjected to a hot dip galvanizing process. The molten metal that is to be applied to the outer member is stirred in order to suspend particles in the molten metal. These particles are referred to as dross. More specifically, dross is the mass of solid impurities that may float on the surface of the molten metal, or may be a heavier impurity that can sink to the bottom of the container holding the molten material. These impurities are usually removed by skimming the surface or screening the molten material before the object is subjected to the hot dip galvanization. In the present invention, these stirred particles within the molten metal provide a beneficial purpose in the creation of a very rough layer of material applied to the outer member. This roughness increases the pull-out capacity, as well as to provide an increased capability for the tube to bond to cementious material placed within the outer member. Therefore, the particles that are normally skimmed from the surface of the molten metal provide a very useful purpose with respect to treating the surface of the outer members.

In yet another embodiment of the present invention, a system is provided for repairing a roadway in which cracking and deterioration of the roadway is caused by a slip plane in the roadbed. The system includes a plurality of soil nails that extend through the slip plane and therefore join the earth on the opposing sides of the slip plane to stabilize the surrounding area. In this configuration, the soil nails are installed at various angles to extend substantially perpendicular to the slip plane. The soil nails each include a protective outer member or tube, an inner support member, and a stabilizing mixture preferably in the form of grout, cement, resin, or combinations thereof. The upper ends of the soil nails terminate below the paved surface of the road. A wire mesh layer is placed over the upper ends of the soil nails and covers preferably a significant portion of the earth lying above the slip plane. The mesh is then held in place by galvanized plates which are fitted over the protruding upper ends of the inner support members. The galvanized plates are then secured to the inner members by, for example, epoxy-coated nuts.

Other features and advantages of the present invention will become apparent by a review of the following figures, taken in conjunction with the detailed description.

DETAILED DESCRIPTION

Figure 1:
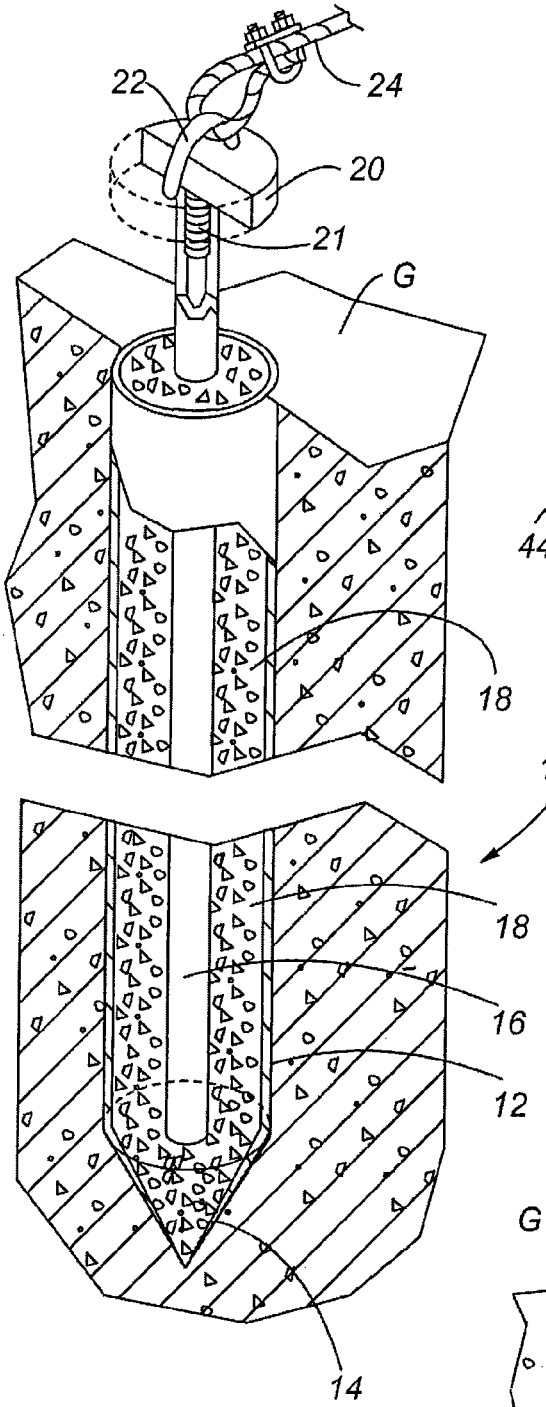
FIG. 1 is a cross-section of the subsurface support of the present invention in a first embodiment, the support device being emplaced in the ground and providing tensioning support to an overlying above ground structure.

Referring to FIG. 1, the subsurface support 10 in a first embodiment of the present invention is shown installed in the ground G. The support device includes an outer member; preferably in the form of a steel or iron tube 12 having a selected length and diameter, and having an integral pointed tip 14. The tip 14 can be conical in shape that facilitates emplacement of the outer tube as by a launcher, as discussed below. After the outer tube is emplaced, the stabilizing mixture is placed in the interior chamber of the outer tube. Then, an inner support member that can be in the form of an epoxy coated steel rod or bar is then placed within the stabilizing mixture prior to hardening of the mixture. When the stabilizing mixture cures, the inner support member 16 can provide support to an overlying structure in compression, tension, and/or shear. Depending upon the design requirements of the particular structure to be built, a plurality of subsurface supports may be emplaced at desired locations at the construction site, and each of the support devices can be sized to provide the necessary support.

FIG. 1 also illustrates one example of the manner in which the support device 10 provides support. This one example illustrates use of the subsurface support as an anchor in tension. The subsurface support 10 includes a head or cap 20 that is connected to the exposed upper end of the inner support member 16. This head or cap can be attached by an integral threaded member 21 that is placed into a threaded well formed in the upper end of the inner support member 16. The cap or head 20 then can be used for attachment to the overlying structure. In the example of FIG. 1, a ring 22 attaches to the cap 20, and a cable 24 connects to the above ground structure (not shown). Thus, in FIG. 1, the support device is used for providing tensioning support to the manmade structure. If the device 10 was needed to provide support in compression, the inner support member 16 could be directly connected to the foundation or other base support of the overlying manmade structure, as further discussed below with respect to FIG. 3.

Figure 2:
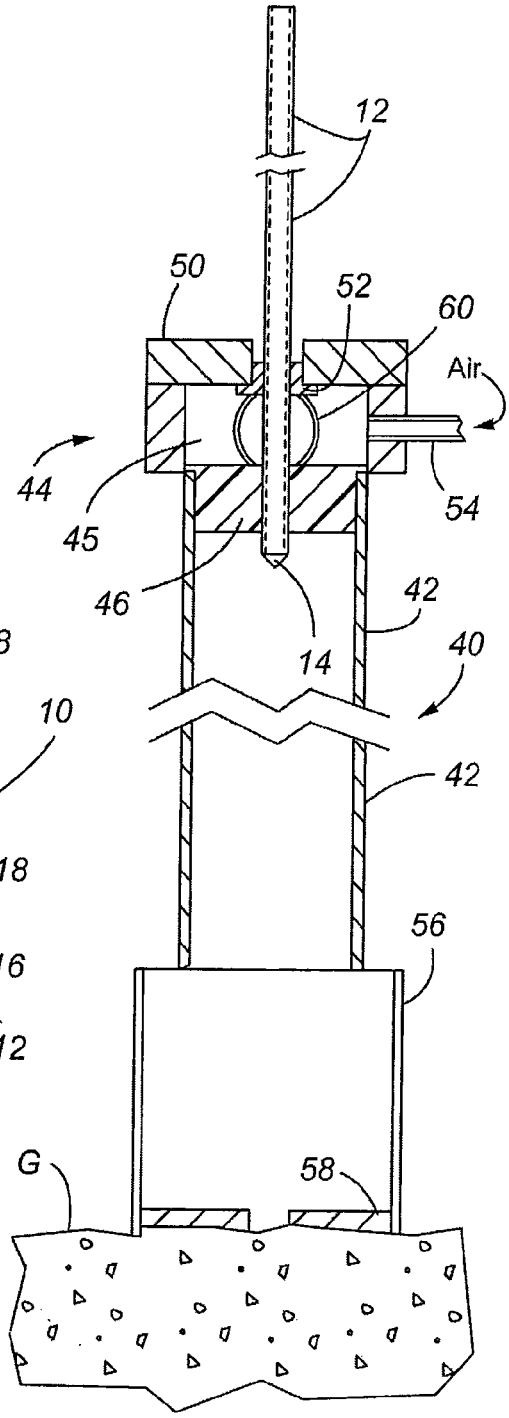
FIG. 2 is a cross-section illustrating an example launcher that may be used to emplace the outer member of the support device.

Referring now to FIG. 2, a launching device 40 is shown as a preferred method in which to emplace the outer member of the device 10. The launcher 40 illustrated in FIG. 2 corresponds to the launcher illustrated in the U.S. Pat. No. 5,044,831, this reference being incorporated herein in its entirety. The launcher 40 is shown in its loaded condition with an outer member/tube 12 loaded in the launcher and ready for firing. The outer tube 12 with the pointed end 14 is capable of penetrating the ground upon sufficient impact force. The launcher 40 comprises a barrel 42 communicating with a breach 44. The breach 44 defines an upper chamber 45. The distal or forward end of the outer tube 12 is received within an annular shaped sabot 46, preferably made of a plastics material, which is slidably received within the barrel 42 adjacent the chamber 45. The trailing or proximal end of the outer tube 12 extends through the chamber 44 and projects rearwards from the launcher 40 through an aperture formed in the cap or upper surface 50 of the breach 44. An annual shaped breach seal 52 seals the outer tube 12 with respect to the upper surface 50. A gas inlet tube 54 communicates with the chamber 45 for the admission of compressed gas. A baffle 56 of a larger diameter than the barrel 40 forms an axial projection of the barrel extending into contact with the surface of the ground G. On firing the launcher, compressed gas is forced into the chamber 45 that causes outer tube 12 to be fired into the ground. The baffle 56 includes a locating ring 58 that forms a snug fit around the sabot 46 such that the launcher remains in alignment with the outer tube that is emplaced in the ground. Accordingly, the outer tube when emplaced remains in coaxial alignment with the barrel 42. As also shown in FIG. 2, the breach seal 52 and sabot 46 may be held in position prior to firing by a plurality of resilient members 60 which exert a separating force between the seal and the sabot.

Although a launcher of a particular construction is illustrated in FIG. 2, it shall be understood that other launcher types and methods can be used to emplace the outer tube within the ground. For example, a launcher that makes use of an explosive charge may be used. Alternatively, a vibratory means may also be used along with some force that helps to ease the outer tube into the ground. As stated above, it is preferable to avoid excavation for emplacement of the outer tube as such excavation is equipment and manpower intensive, and environmentally unfriendly.

Figure 3:
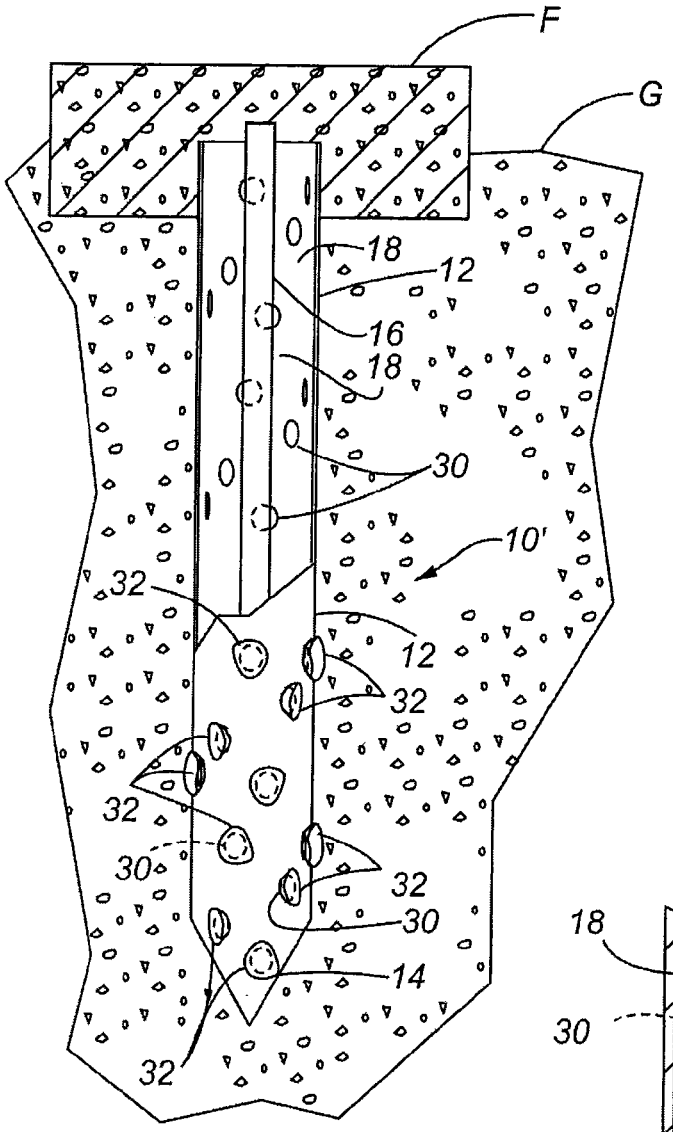
FIG. 3 is a partial cross-section illustrating a second embodiment of the support device emplaced in the ground and providing compression or bearing support to an overlying structure.

FIG. 3 illustrates a second embodiment 10' of the present invention. The support device 10' is the same as shown with respect to the subsurface support of the first embodiment, with the exception of a plurality of perforations/openings 30 which may be formed in the outer tube 12. FIG. 3 also illustrates the device 10' used to support an overlying structure S in compression. More specifically, the device 10' has its upper end 28 embedded within a concrete foundation F of a structure S. The foundation is shown as extending a distance below ground level G. As also shown in FIG. 3, the plurality of perforations/openings 30 which may be formed in the outer tube allow the stabilizing material 18 to flow out from the openings 30, thus forming external stabilizing structures 32. In compression or tension, these external stabilizing features 32 help to strengthen the connection of the device 10' to the surrounding soil. When filling the interior chamber of the outer tube with the stabilizing mixture 18, such filling may take place under pressure so that a desired quantity of the stabilizing mixture 18 exits the perforation/openings 30, thereby forming the external stabilizing features 32. In order to completely fill the interior chamber of the outer tube, it may be preferable to commence filling of the chamber from the lower most portion of the chamber. A line (not shown) carrying the stabilizing mixture under pressure can be inserted in the chamber and extend to the lower most end of the support device, and then as the stabilizing mixture fills the chamber, the line may be raised as necessary. Those skilled in the art can envision other ways in which the stabilizing mixture can fill the chamber of the outer tube.

Figure 3A:
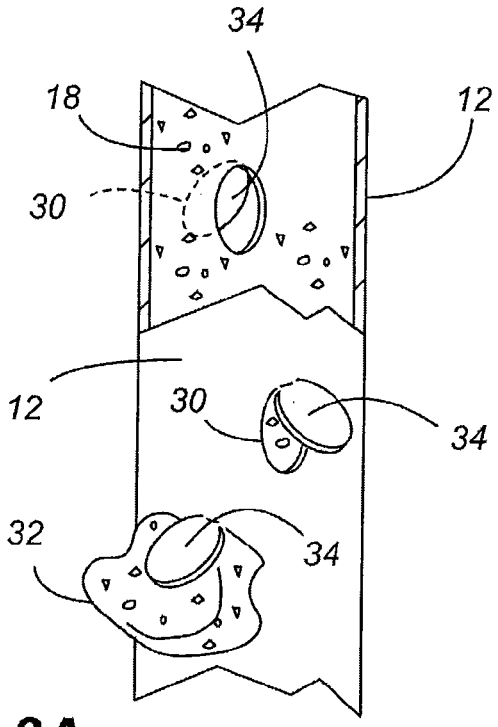
FIG. 3A is an enlarged section of FIG. 3 illustrating one way in which to provide holes or perforations in the subsurface support.

Now referring to FIG. 3A, an enlarged section of the support device 10' is shown specifically illustrating one manner in which holes or perforations may be made in the outer tube 12. In FIG. 3A, the openings 30 are formed by creating moon shaped cutouts thereby leaving a chad or tab 34. The chad or tab 34 would be pushed away from the exterior surface of the outer tube 12 as the pressurized stabilizing mixture exited the interior chamber of the outer tube. Alternatively, holes could be drilled or punched in the outer tube 12 in order to create an opening by which the stabilizing mixture could flow through. Those skilled in the art can envision other ways in which openings may be formed through the outer tube 12 in order to facilitate flow of stabilizing mixture therethrough to create the external stabilizing features 32.

Figure 4:
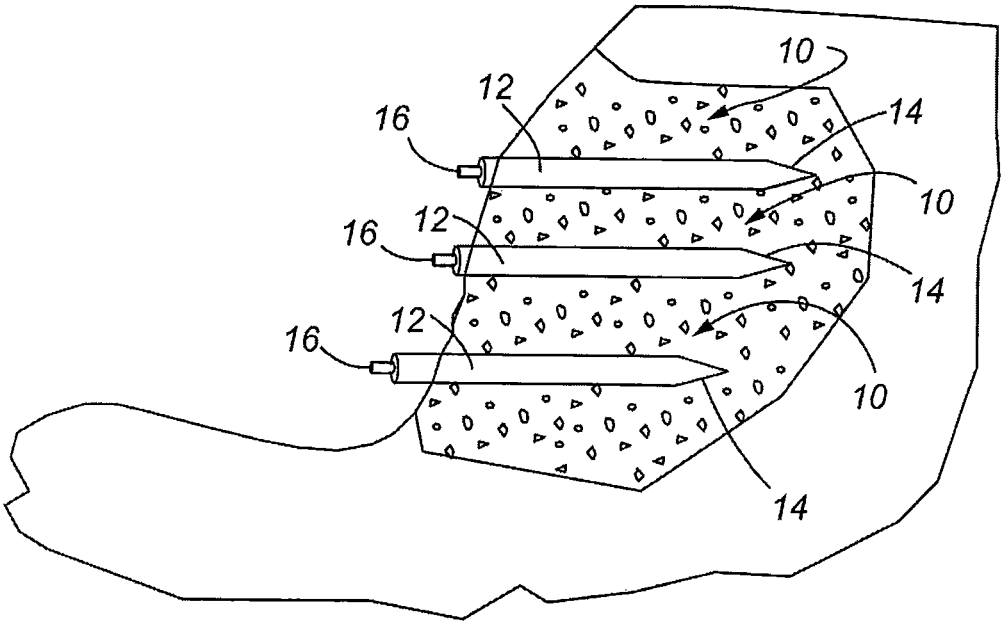
FIG. 4 is a simplified elevation of a plurality of support devices that may be used as passive soil nails or as tiebacks to stabilize a sloping surface, the supports being emplaced in a horizontal orientation.

FIG. 4 illustrates use of the subsurface support of the invention to stabilize a sloping surface. In the figure, three support devices 10 are illustrated and are spaced from one another in a desired arrangement to best support the sloping surface. The support devices are disposed in a horizontal orientation, but it shall be understood that the support devices may be placed at any angle or orientation depending upon the surrounding terrain. The support devices in FIG. 4 would be representative of use of the supports as either passive soil nails or tiebacks.

Additionally, the subsurface support of the present invention can be used in combination at a particular jobsite to support an overlying structure and to stabilize surrounding soil. In this case, one or more support devices can be structurally connected to an overlying structure such as shown in the figures, and one or more additional support devices can be used as soil nails to stabilize the surrounding soil or rock formation. Even in tunnel construction, the support device of the present invention can be used to stabilize the soil or rock formation surrounding the tunnel. In a tunnel, a support device can be emplaced in any orientation to include stabilizing the ceiling/upper surface of the tunnel.

Figure 5:
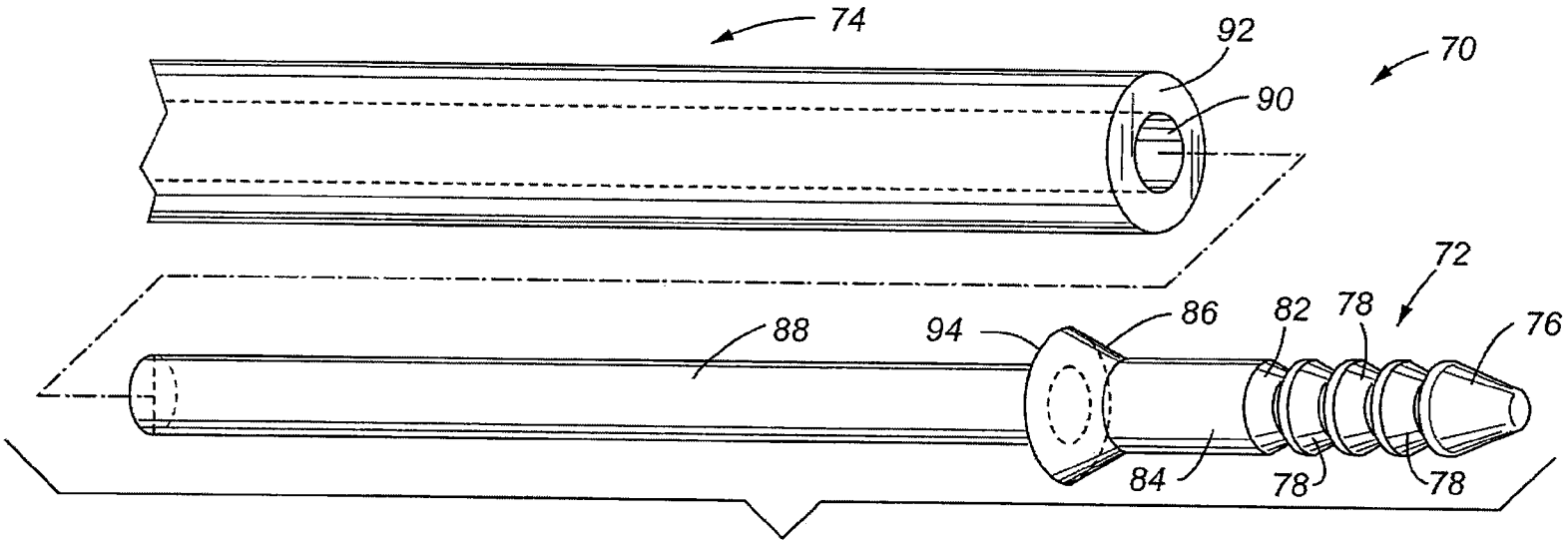
FIG. 5 is an exploded fragmentary perspective view of a third embodiment of the present invention in the form of an improved soil nail.
Figure 6:
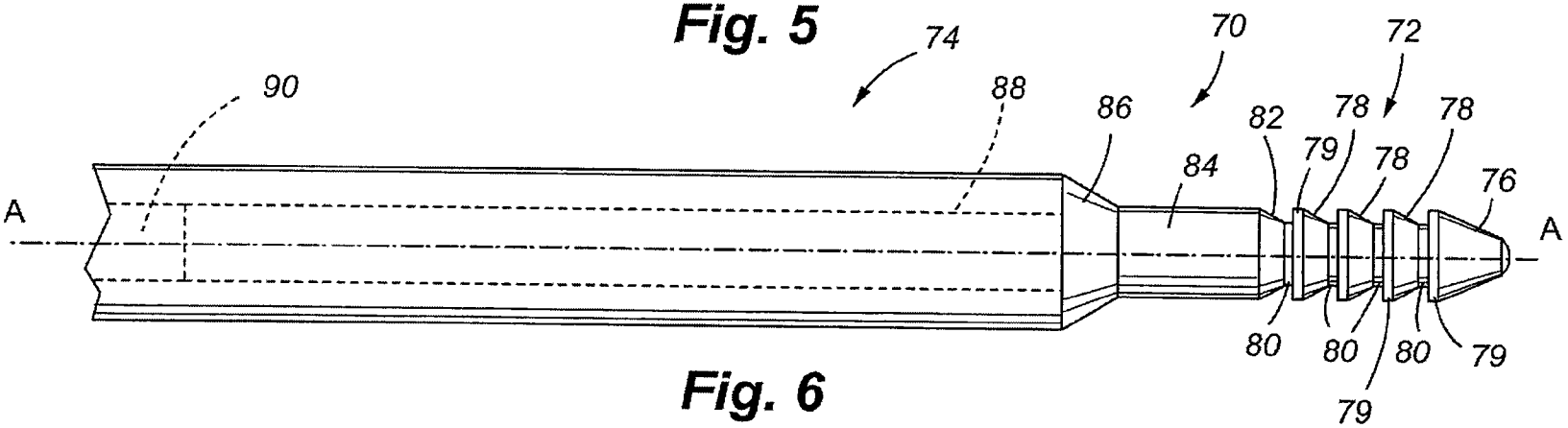
FIG. 6 is a fragmentary side view of the soil nail of FIG. 5.

FIGS. 5 and 6 illustrate yet another preferred embodiment of the present invention, namely, an improved soil nail 70 of dual material construction. As shown, the nail 70 includes a contacting portion or stinger 72 that attaches to a fiberglass body 74. The soil nail extends symmetrically along a longitudinal axis A-A. The stinger 72 comprises a conical distal tip 76, and a plurality of axially aligned flanges 78 that extend proximally from the tip 76. Spaced between the flanges 78 are neck sections 80 defining portions of the stinger with smaller diameters. A transition flange 82 interconnects the most proximally located neck section 80 to an intermediate extension 84. A shoulder 86 defines the interface with the distal end of the body 74. A base portion 88 extends from the shoulder 86, and is inserted within the opening 90 formed in the distal end of the body 74. Preferably, the distal end 92 of the body 74 has a flat surface thus providing a complementary flat mating surface with the contacting face 94 of the shoulder 86. As shown, the stinger components are generally smaller in diameter than the diameter of the body 74. Further, the flanges 78 generally have a similar diameter as compared to the large end of the conical distal tip 76. The conical tip 76 and flanges 78 may further include peripheral edges 79 that extend generally parallel to the longitudinal axis A-A of the soil nail. The base portion 88 preferably extends approximately one foot within the opening 90 if the exposed part of the stinger has a length of approximately six inches. If a longer stinger is used, then preferably the base portion extends further into the opening 90 in order to provide adequate support. The base portion may be secured by a compression fitting in opening 90 and/or an appropriate bonding agent can be used.

Figure 7:
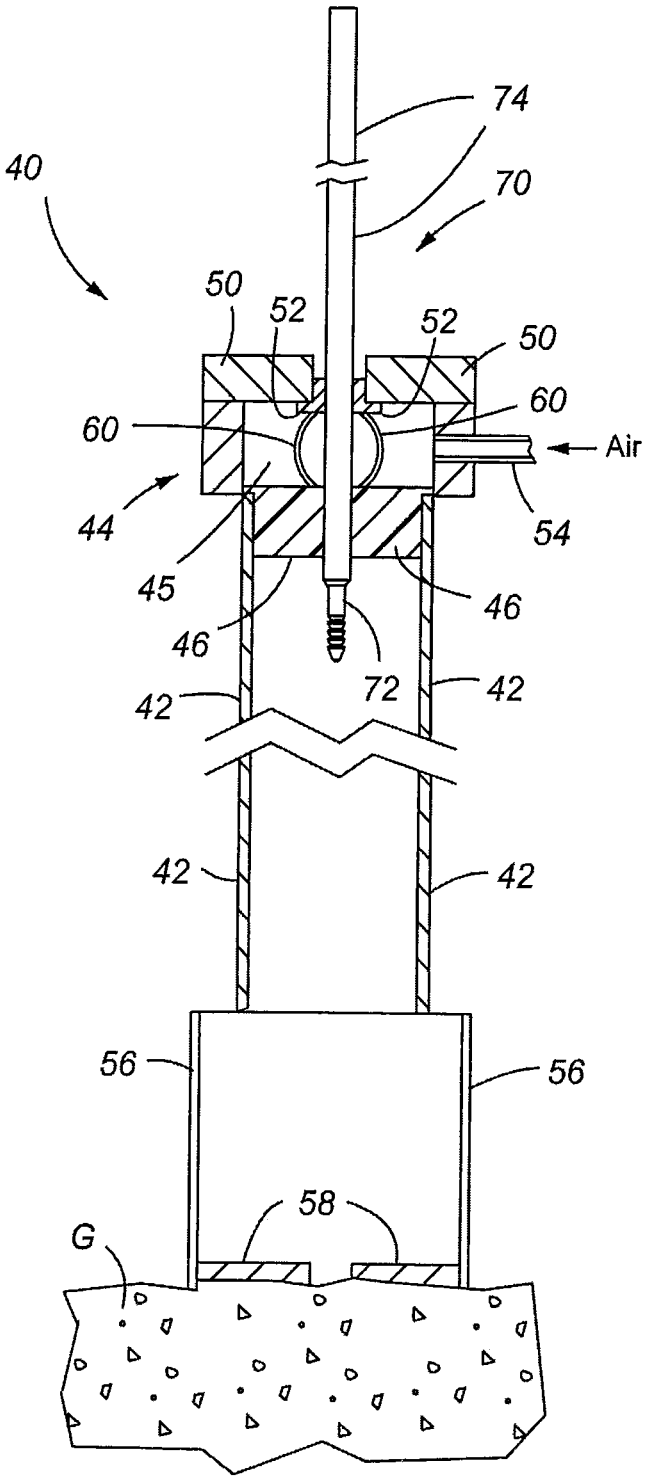
FIG. 7 is a cross section similar to FIG. 2 illustrating the soil of the third embodiment being loaded in the launcher.

Referring to FIG. 7, the soil nail 70 is shown as mounted within the soil nail launcher 40 of FIG. 2. The soil nail 70 is emplaced in the same manner as the outer tube 12 described in the first embodiment; however, it being understood that the soil nail 70 is a subsurface support that can also be completely buried within the soil without exposing an upper end thereof.

Figure 8:
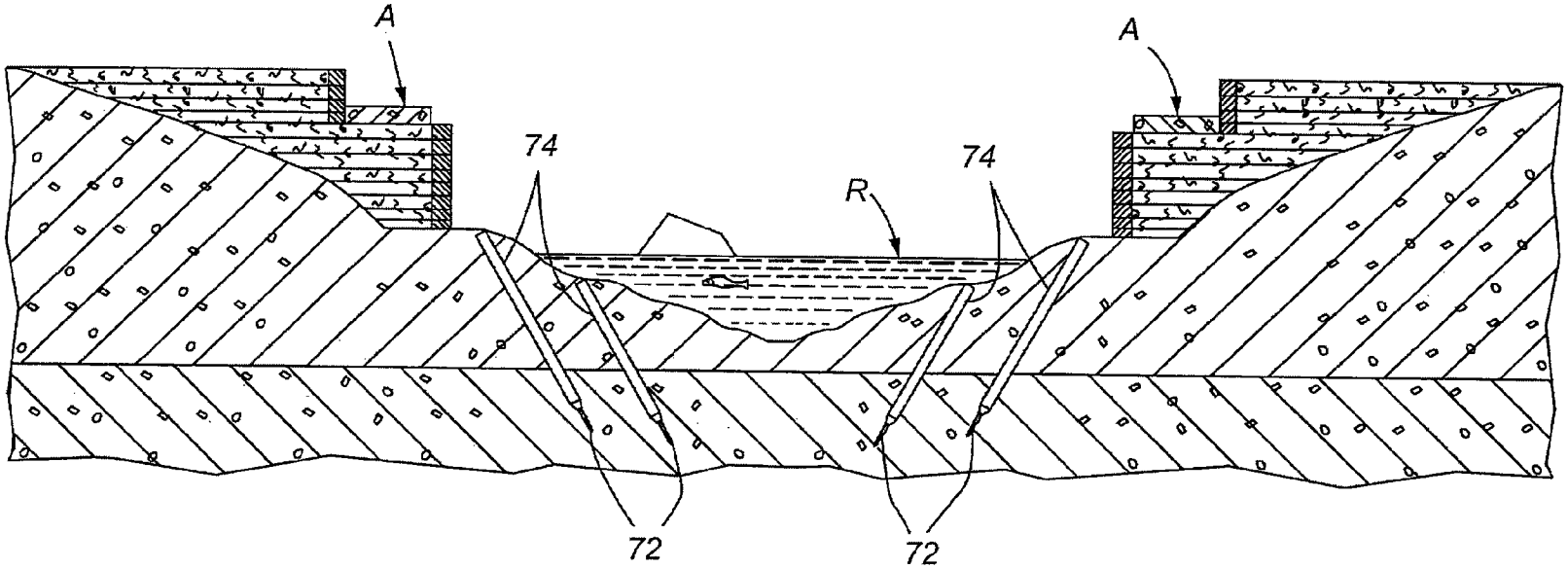
FIG. 8 shows an example installation of the soil nail of the third embodiment to reinforce soil near a river or streambed against scouring.

FIG. 8 shows an example use of the soil nails 70. This figure specifically shows a number of soil nails 70 installed in and around the bed of a body of water, such as a stream or river R to thereby stabilize the soil around the bed. The soil nails 70 have been placed adjacent some abutments A that may be used to stabilize an overhead structure such as a bridge (not shown). Scouring and other types of erosion can be remedied with use of soil nails in this manner. It shall be understood that the soil nail of the present invention can be used in many other applications, and FIG. 8 is simply one example.

Figure 9:
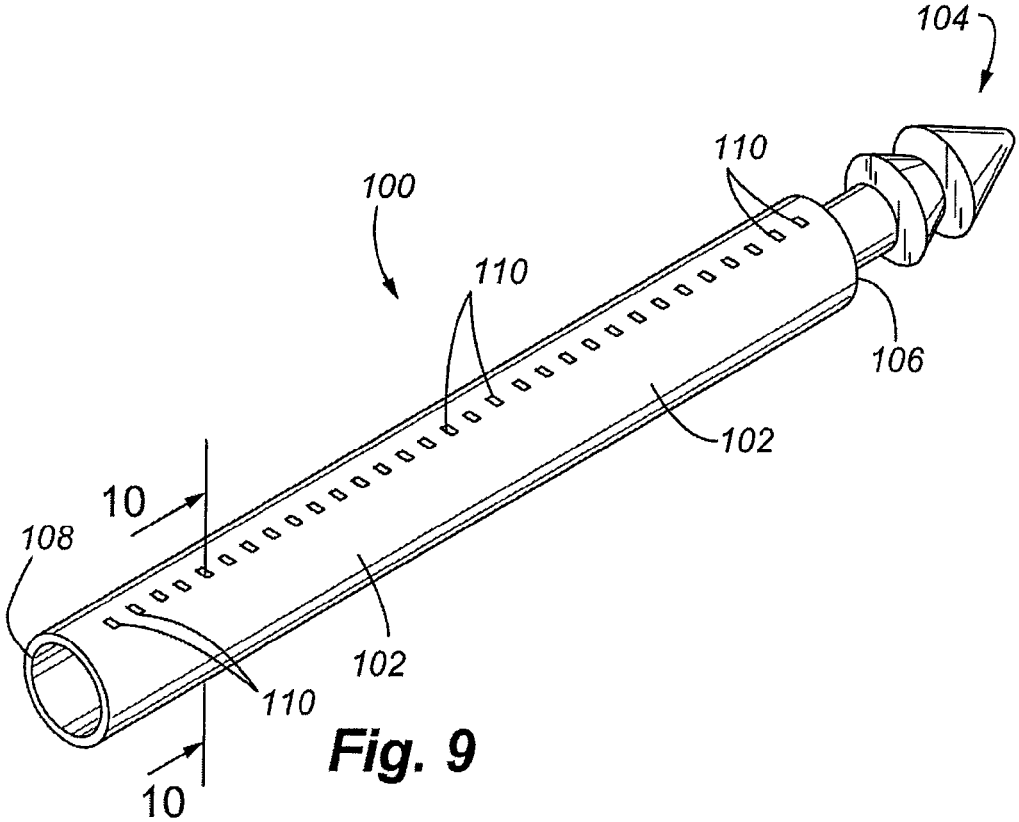
FIG. 9 illustrates yet another embodiment of a subsurface support of the present invention in the form of a soil nail.
Figure 10:
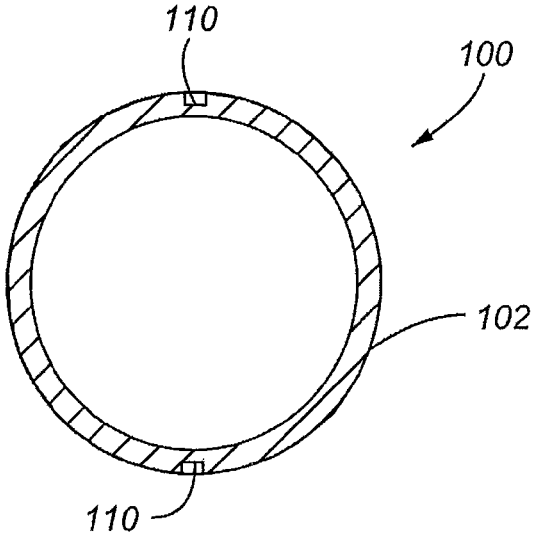
FIG. 10 is a cross-section taken along line 10-10 of FIG. 9.

FIG. 9 illustrates yet another soil nail embodiment of the present invention. The soil nail 100 of FIG. 9 includes a plurality of surface asperities that improve the pull out capacity of the soil nail. Once a soil nail is in place, it is advantageous for the soil nail to remain in place without slippage or pull out. With respect to the embodiment shown in FIG. 3, pull out capacity is improved after the cementious material exits the location of the external stabilizing features. However, there is also a need to provide a soil nail with improved pull out capacity wherein such features are not activated in a later processing step, but rather, are formed integrally with the soil nail prior to placement. In the embodiment of FIG. 9, the body 102 of the soil nail 100 includes a plurality of dimples or indentations 110 formed in a linear pattern. Referring also to FIG. 10, these indentations 110 preferably do not pass through the entire thickness of the wall of the soil nail thereby maintaining better structural integrity of the soil nail whereas a plurality of holes made in the same linear fashion might otherwise decrease the overall strength of the soil nail such that it may break apart upon being fired from a launcher into the ground, or may prematurely deteriorate in the soil. The surface asperities caused by the indentations enhance the pullout capacity of the soil nail without materially weakening the construction of the soil nail. FIG. 9 also illustrates an optional stinger 104 attached to the distal end 106 of the soil nail. Therefore, as discussed above with respect to the embodiment shown in FIGS. 5 and 6, the stinger may be used to further improve the pullout capacity of the soil nail.

Although the indentations 110 are shown as extending uninterrupted between the proximal end 108 and the distal end 106, it is also contemplated that the indentations could be provided in a discontinuous pattern, a continuous pattern, or combinations thereof. Additionally, while the indentations are shown as being provided in a linear orientation, it is also contemplated that the indentations could be provided in a non-linear or random fashion.

Figure 11:
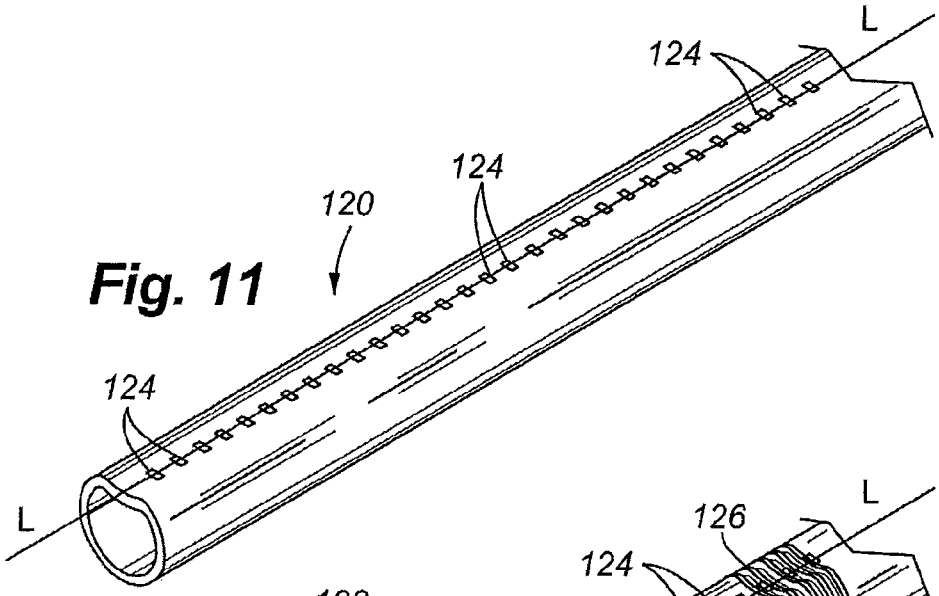
FIG. 11 is a perspective view of a modification of the embodiment of FIG. 9.

FIG. 11 illustrates a modification to the embodiment of FIG. 9 wherein a combination of surface asperities or features are provided to improve the pull out capacity of the soil nail. In FIG. 11, the soil nail 120 has at least one linear set of indentations 124, as well as being deformed along a linear line L following the path of the indentations 124. The deformed shape of the bar, as well as the indentations each improves the pull out capacity of the soil nail.

Figure 12:
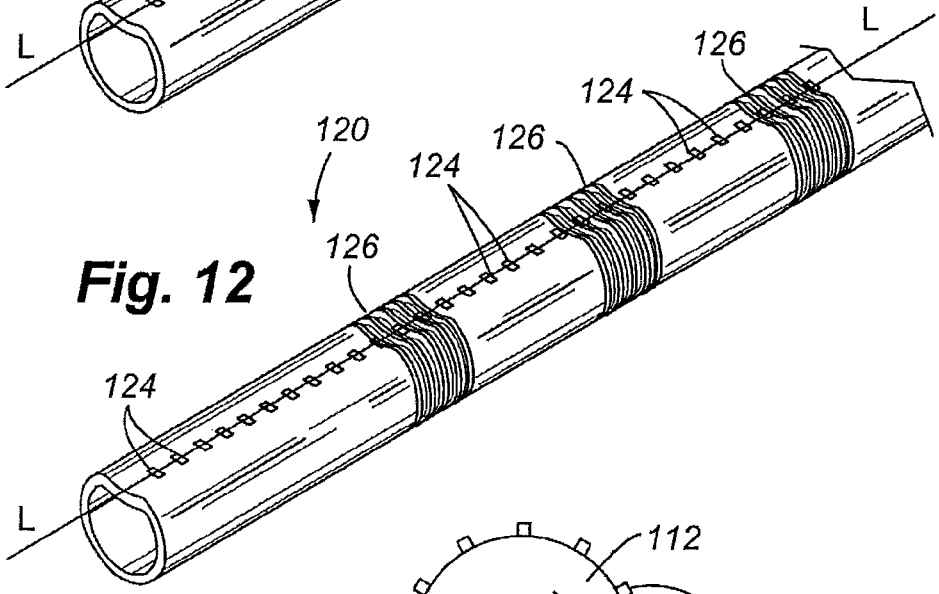
FIG. 12 is a perspective view of yet a further modification of the embodiment of FIG. 9.

FIG. 12 shows yet another modification to the embodiment of FIG. 9. This soil nail is also deformed along a linear line following a path of the indentations 124, but further includes a plurality of threaded portions 126 spaced along the length of the soil nail. The threads also increase the pull out capacity of the soil nail, and are features that can be formed prior to a placement of the soil nail.

Figure 13:
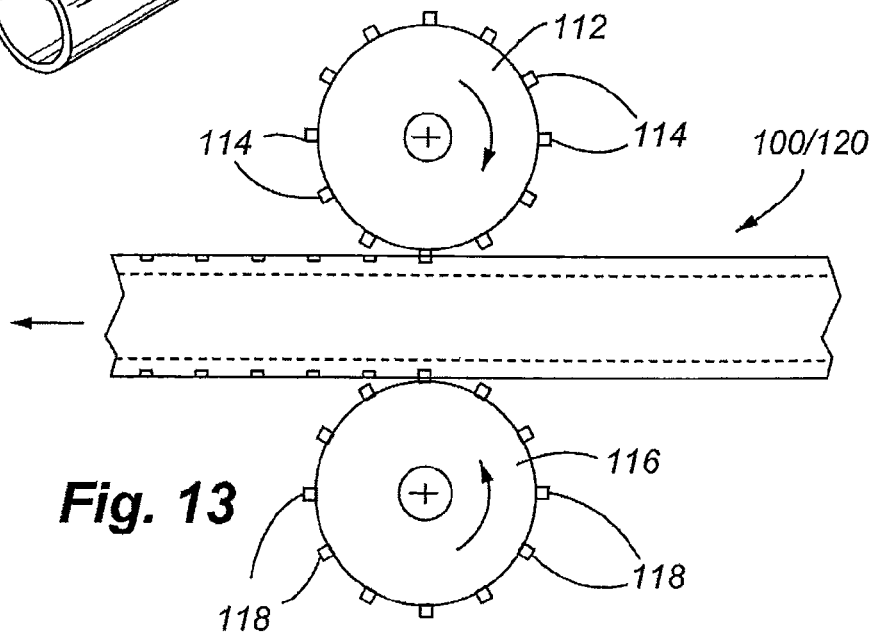
FIG. 13 is a schematic diagram illustrating a method of manufacturing the embodiment of FIG. 9.

FIG. 13 illustrates a method by which a linear set of indentations may be formed on opposite sides of the soil nail 100 in accordance with the embodiment of FIG. 9. As shown, an upper sprocket 112 has a plurality of teeth 114 formed on the outer surface thereof, similar to a sprocket for a bicycle. A lower sprocket 116 with teeth 118 are also provided, and disposed on an opposite side of the soil nail. In order to form the indentations, the bar is orientated so that it passes between the sprockets, and the sprockets then rotate about their respective central axes to form the indentations on the outer surface of the soil nail.

With respect to a method of making the soil nail shown in FIG. 12, a first step may include creating the various sets of threads 126 on the outer surface of the soil nail. In the next step, the indentations 124 can be formed in the manner shown in FIG. 13. Additionally, it is contemplated that the amount of force or pressure provided by one or both of the sprockets 112 and 116 could be increased such that the body of the soil nail is deformed along the path of the indentations.

Figure 14:
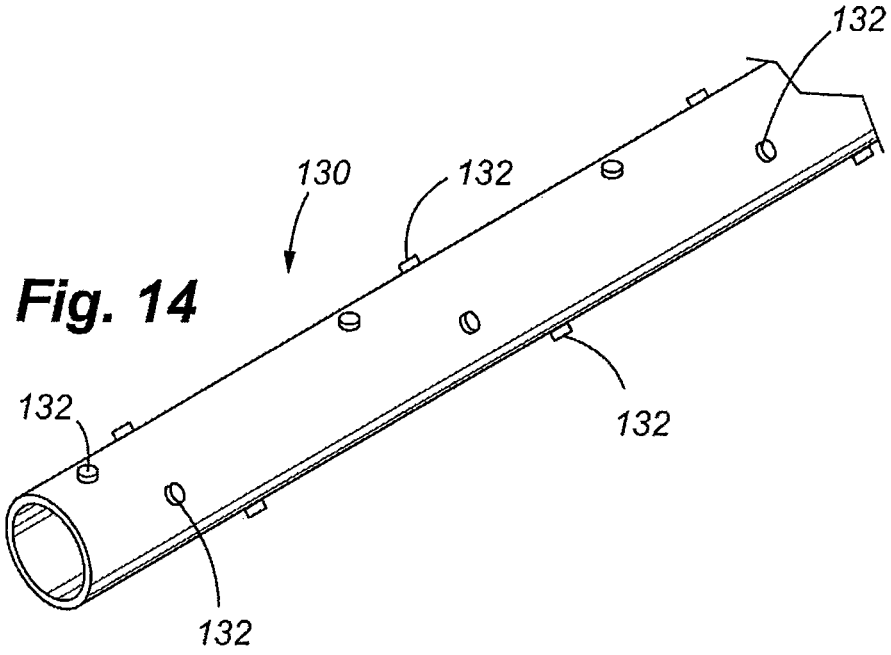
FIG. 14 is a perspective view of yet another embodiment of the present invention showing a soil nail with protruding asperities.

FIG. 14 illustrates yet another embodiment of the present invention. In this embodiment, the soil nail 130 has a plurality of small asperities formed on the outer surface of the nail. The asperities in this preferred embodiment are shown as small protrusions 132. The protrusions are relatively small in comparison to the tabs 34 shown in the embodiment of FIG. 3A. The protrusions 132 help in increasing the pullout capacity of the soil nail. One method to create the protrusions 132 is to weld small pieces of material to the soil nail. The protrusions 132 can be used with a soil nail that is launched from launcher 40 without concern that the protrusions will create excessive interference which otherwise might deform or break the nail upon being launched. The protrusions can be provided in a geometrically spaced pattern or randomly on the outer surface of the soil nail. One acceptable general size for the protrusions may include those that protrude approximately one-eighth to one-half inch away from the outer surface of the soil nail. Spacing between each of the protrusions may be approximately 4-6 inches.

It is also contemplated that the protrusions 132 could also be combined with the other asperities shown in FIGS. 9-12. Thus, a composite group of asperities could be provided on a soil nail to optimize pull out capacity. A desired combination of the asperities can be tailored to match optimum pullout capacity based on the type of soil and rock formations present.

With respect to launching the soil nails illustrated in FIGS. 9-12 and 14, the launcher 40 illustrated in FIG. 2 can be used without requiring modification.

Figures 15, 16, 18:
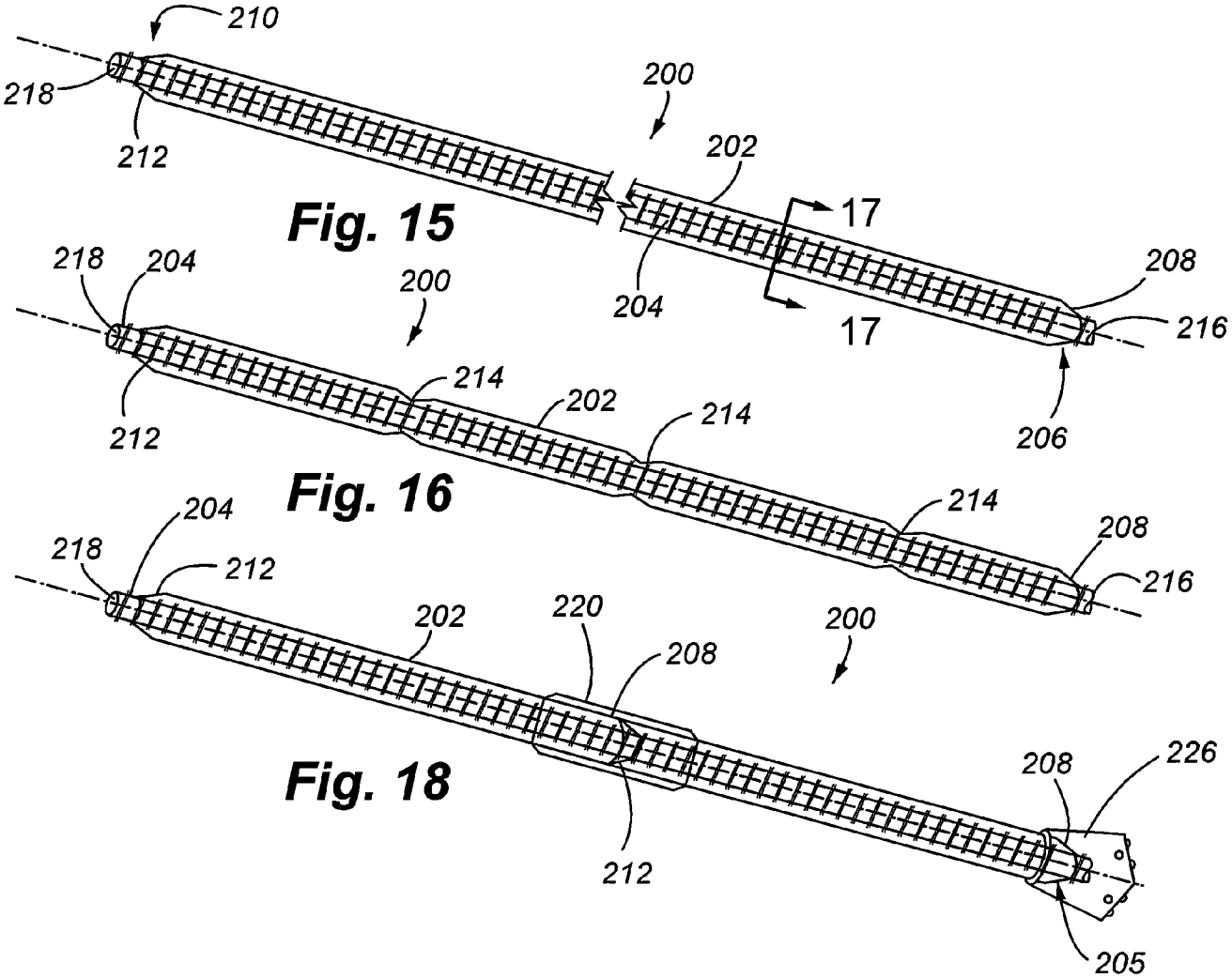
FIG. 15 is a perspective view of another embodiment of the subsurface support of the present invention.
FIG. 16 is a perspective view of the embodiment of FIG. 15 including additional crimps along the middle of the support.
FIG. 18 is a perspective view of another embodiment including two outer members interconnected by a coupler thereby extending the length of the support.

Referring now to FIGS. 15 and 16, in another embodiment of the present invention, a subsurface support 200 is illustrated. In this embodiment, the support 200 includes an outer member or tube 202 and an inner member, such as a length of rebar 204 that is placed within the outer member 202. The outer member 202 has a plurality of locations at which the hollowed bore or opening 205 of the outer member 202 is made smaller by crimping the outer member. In FIG. 15, there are two crimped locations, namely, one crimped area 208 at the distal end 206 of the outer member, and another crimped area 212 located at the proximal end 210 of the outer member 202.

In FIG. 16, there are three additional crimped areas 214 located between the proximal and distal ends of the outer tube 202. Depending upon the length of the outer member, it may be advantageous to provide one or more intermediate crimped areas which ensure the inner member maintains a uniform concentric spaced relationship with respect to the outer member.

Figure 17:
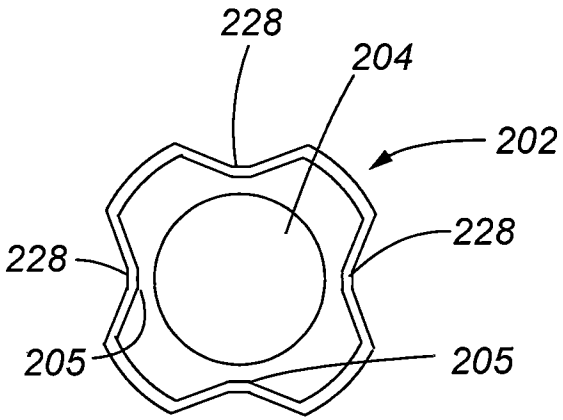
FIG. 17 is a cross sectional view taken along line 17-17 of FIG. 15.

Referring to FIG. 17, this cross-section illustrates the outer member 202 being crimped. As shown, the outer tube maintains its normal diameter or shape at spaced locations along the outer periphery of the outer tube; while a plurality of crimped sections 228 make the opening or bore 205 smaller at that location.

Referring to FIG. 18, another configuration is shown with respect to the subsurface support 200 in which the length of the support is extended by use of two outer members interconnected by a coupler. A proximal end of a first outer member is attached to a distal end of an adjacent or abutting outer member and these members are connected to one another by a threaded coupler 220. One way in which the coupler 220 may connect the abutting ends of the outer members is by a threaded connection in which the outer peripheral surfaces of the abutting ends may have an external thread, and the coupler may have an internal thread. As also shown, the inner member 204 extends continuously through the bores of both of the outer members 202. This figure also illustrates the use of a self-drilling bit 226 that can be used for emplacement of the subsurface support in which the subsurface support is drilled into the ground and the self-drilling bit 226 remains within the ground when the subsurface support is drilled to a desired depth.

With respect to installation of the subsurface support 200, there are a number of methods by which these subsurface supports can be emplaced. One contemplated method is to launch the subsurface support 200 in which there is a single outer member 202. The distal end, since it is crimped, has a smaller cross-sectional area that enhances its ability to be launched into the ground without requiring a separate tip piece. In order that the opening at the distal end does not become clogged with soil or rock, a removable cap (not shown) can be placed over the opening. Alternatively, a hole may be drilled, and the outer member is placed in the hole. As mentioned, the support 200 may also have a self drilling capability in which the support is attached to a drilling tool and the self-drilling bit 226 facilitates drilling.

Once the outer member is emplaced, it is filled with cementious material by use of, for example, a pressurized grout tube placed within the opening 205. After filling the opening 205, the inner member 204 is inserted through the opening 205 and through the length of the outer member. As shown in the figures, the distal end of the inner member 216 may protrude beyond the distal end 206 of the outer member. Similarly, the proximal end 218 of the inner member 202 may extend beyond the proximal end of 210 of the outer member 202. As shown in the cross-section of FIG. 17, the inner bar or member 204 maintains a uniform spacing between the outer surface of the inner member and the interior surface of the outer member. By maintaining the spaced relationship between the inner and the outer member, the inner member does not rest against or otherwise lie in a position that is too close to the inner surface of the outer member. Accordingly, the grout will fill the space between the inner and outer members to provide additional strength for the soil nail support. Particularly in installations where the soil nail may be placed in a more horizontal location, without providing some means to maintain uniform spacing between the inner and outer member, the inner member will have a tendency to lie against the outer member therefore minimizing the effectiveness of the inner member.

Figure 19:
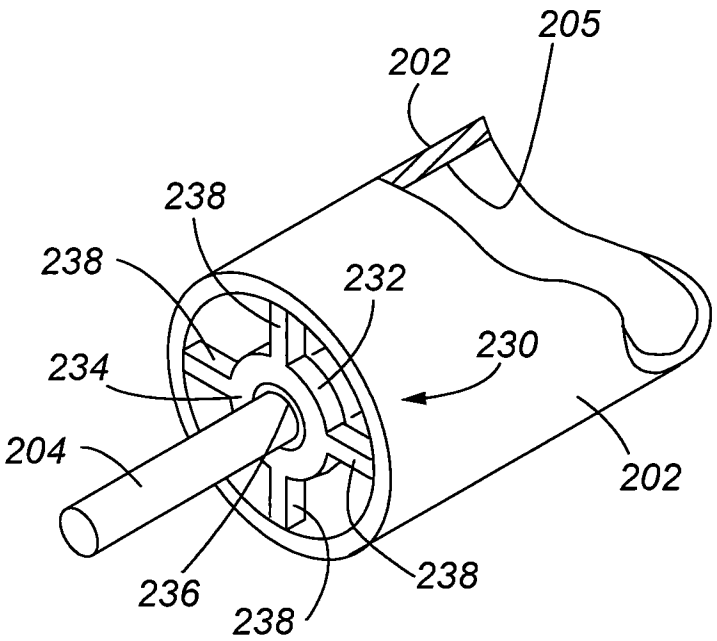
FIG. 19 is a perspective view of another embodiment of the present invention in which the centering feature includes an insert or spacer.

Referring to FIG. 19 in yet another embodiment of the present invention, in lieu of providing crimps to narrow the diameter of the outer member an insert or spacer 230 is used to offset or space the inner member from the outer member.

In FIG. 19 the insert 230 is shown as being placed within the inner bore 205 of the outer member 202. The insert includes an outer peripheral portion 232 that is placed in frictional engagement with the inner surface of the outer member, an inner concentric portion 234 with an opening 236 that receives the inner member 204, and a plurality of radial supporting projections 238 that interconnect the inner concentric portion 234 with the outer peripheral portion 232. The radial supporting projections 238 enable grout to pass through the spacer 230 when the outer member is being filled. The size of the opening 236 is adapted to receive the inner member 204 and the inner member will maintain a uniform spaced relationship with the interior surface of the outer member.

The insert 230 can be used at various locations along the length of the outer member to include intermediate between the proximal and distal ends, as well as placed at the proximal and distal ends.

Figure 20:
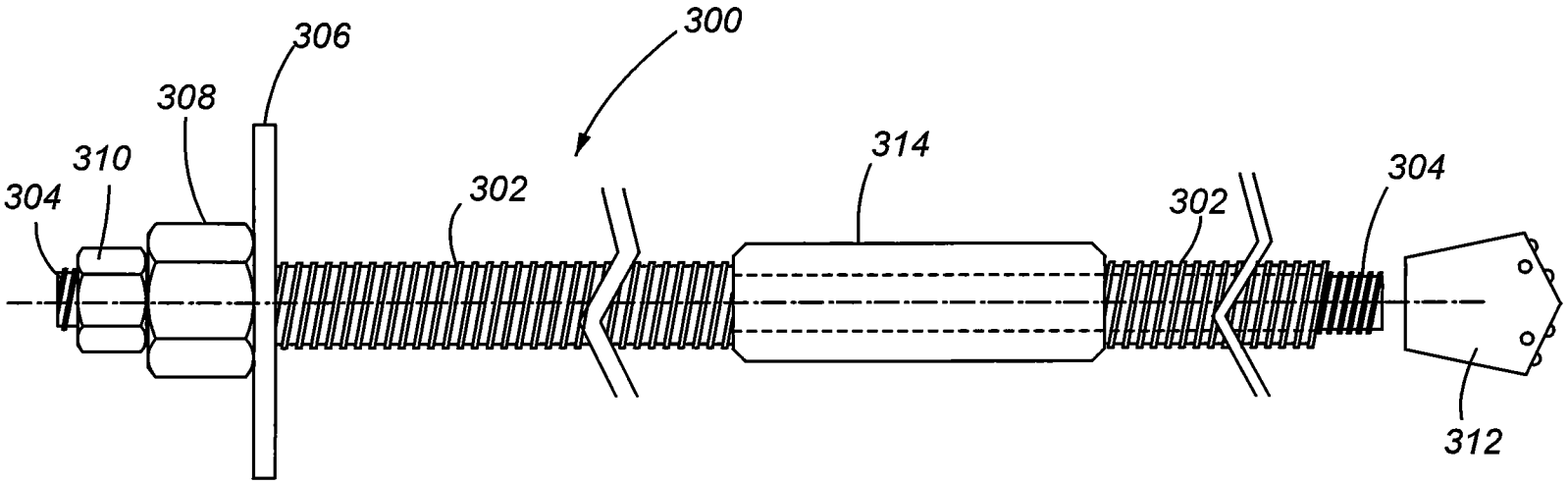
FIG. 20 is a side view of another embodiment of the subsurface support including a composite construction of steel and fiberglass materials.

Referring to FIG. 20, a composite self-drilling soil nail 300 is illustrated in another embodiment. The soil nail includes a threaded outer member 302 and a threaded inner member 304 which is received through the bore or opening of the threaded outer member. The bore of the outer member may be smooth or may also be threaded to receive the inner member. A bearing plate 306 is placed over one end of the soil nail, and the bearing plate has a central opening which is large enough to receive the outer member. The bearing plate is shaped and sized for holding the particular geological feature being stabilized. An outer securing nut 308 is threaded over the outer tubular member 302 and is tightened against the abutting surface of the bearing plate 306. An inner securing nut 310 is then threaded over the threaded inner member, and tightly against the abutting surface of the outer securing nut 308. A self-drilling tip 312 is secured to a distal end of the soil nail 300. The soil nail may be extended in length by providing more than one section or length of the outer member 302. Accordingly, two outer members may be placed end to end and connected by a threaded outer tube coupler 314.

In another aspect of the present invention, surface asperities may be formed on a soil nail by a galvanization process. The outer support member is dipped in a molten metal, such as zinc. Prior to dipping, the galvanizer tank is stirred to mix the dross. Therefore, it is preferable that none of the dross should be skimmed or removed from the galvanizer tank. The molten metal along with the dross adheres to the surfaces of the member being dipped. Upon drying, the galvanized layer has a very rough texture. This rough texture increases the pull-out capacity of the soil nail, also increases the bond capability between the interior surface of the bore and grout or other cementious material placed within the outer member. Thus, the suspended dross particles which are normally removed from the molten material in a galvanization process provide a very useful purpose in creating a soil nail having an outer member with surface asperities. Additionally, it is contemplated that the inner member can also be subjected to this type of galvanization process in order to increase surface asperities on the inner member that also improves bond between the grout in the bore of the outer member and the inner member.

Figure 21:
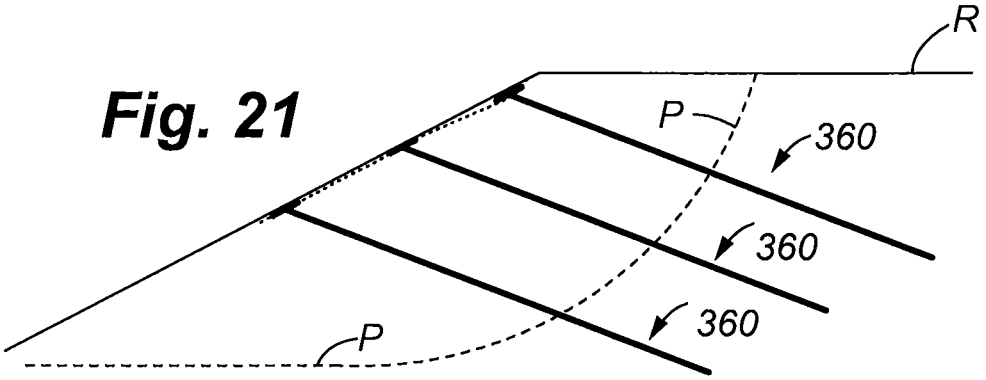
FIG. 21 is a schematic view of a roadway repair along a slip plane using a plurality of subsurface supports.

FIG. 21 illustrates a plurality of soil nails 360 that are used to repair a roadway in which a slip plane P exists in the roadbed area below the road surface R. Without disrupting the slip plane, continual cracking of the roadway will occur as the slip plane continues to shift over time. Therefore, numerous attempts to simply repair the road surface will be unsuccessful as the problem lies in the earth beneath the road surface. As shown, a plurality of the soil nails 360 are use in combination and extend substantially perpendicular to the slip plane P thereby stabilizing the soil on both sides of the slip plane and interrupting the capability of the slip plane to naturally shift over time.

Figure 22:
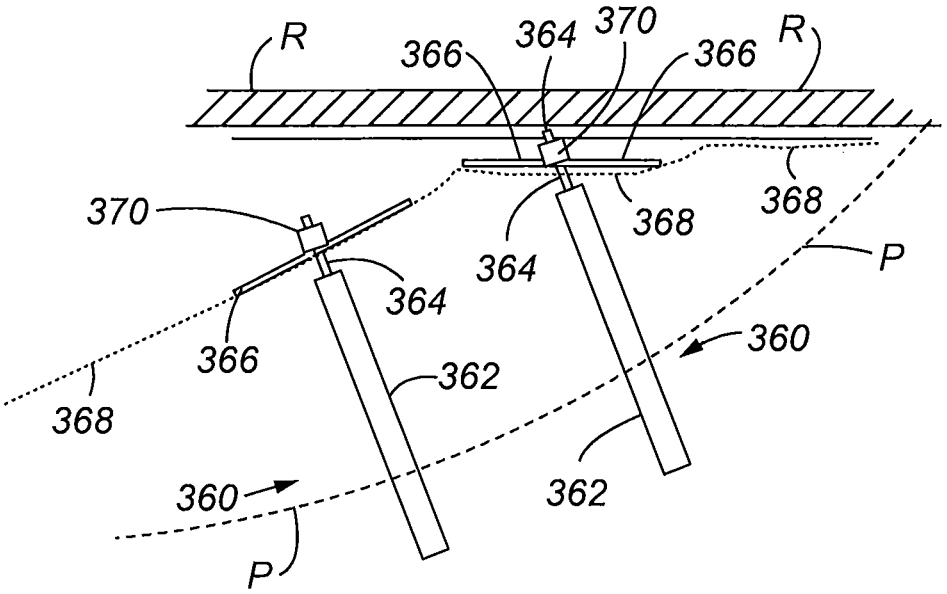
FIG. 22 is an elevation view showing further details of a soil nail of FIG. 21 when installed to repair the roadway.

Referring also to FIG. 22, the construction of each of the soil nails 360 include the use of an outer member 362, and inner member 364 that is placed within the outer member 362, in which grout, resin or other cementious material is used to hold the inner member 364 within the outer member 362. For the area excavated above the slip plane P, a wire mesh material 368 is placed. The mesh provides further support for the soil nails, as well as to further disrupt the ability of the slip plane to shift. The mesh 368 is secured to each of the soil nails by, for example, an epoxy-coated nut 370 that is tightened against the galvanized plate 366. The galvanized plate 366 is also sized to provide necessary support to prevent shifting of the soil. Finally, the roadway R may be repaired in which the soil nails are entirely located below the roadway R.

With the method and apparatus of the present invention, a subsurface support is provided which can be emplaced with a minimum of effort. In one advantage of the present invention, the subsurface support provides an alternative to other anchoring means because the outer tube provides protection to the inner support member from corrosion or other undesirable environmental factors. Depending upon the geological conditions, the outer tube can be emplaced with a launching device that is adapted to account for varying geological formations. For example, ground formations with little rock allows emplacement of the outer tube with a minimum of force while placement of the outer tube into an actual rock formation would require a greater force provided by the launching mechanism. In any case, the particular launching device chosen may have the capability of emplacing the outer tube to the appropriate depth and through various rock and soil conditions. In another advantage of the present invention, an improved soil nail is provided in a two-piece construction. This construction is cost effective yet provides at least the same performance as compared to a soil nail made of a single piece of material. While surface asperities are illustrated with respect to the embodiments shown in FIGS. 9-14, the other subsurface supports of the invention may also include such surface asperities to improve pull out capacities.

In some of the preferred embodiments, means is provided to maintain a uniform spaced relationship between the inner member and the outer member to maximize the strengthening effect of the inner member for both applications in tension and compression. These means include crimped features formed directly on the outer member or the use of inserts placed within the outer member.

The outer members may be placed in series to extend the length of the support in which a threaded coupling is used to join abutting outer members. A self-drilling bit may be used for direct installation of the outer tube without having to conduct a separate drilling step.

While the method and the apparatus of the present invention have been provided in various preferred embodiments, it shall be understood that various other changes and modifications may be made within the spirit and scope of the present invention.

What is claimed is:

1. A soil nail comprising:

a first outer member having a bore extending therethrough;

a second outer member having a bore extending therethrough;

a coupler interconnecting adjacent ends of the outer members;

a threaded inner member placed through the bores of the first and second outer members wherein said bores of outer members are threaded to receive the threaded inner member;

a bearing plate having an opening, and said bearing plate placed over a proximal end of the first threaded outer member;

an outer nut placed in threaded engagement with the first outer member, and said outer nut secured against a facing surface of the bearing plate; and a drill tip secured to a distal end of said inner member and said second outer member enabling said soil nail to be self-drilled.

2. A soil nail, as claimed in claim 1, wherein: said coupler is made from metal.

3. A soil nail, as claimed in claim 1, wherein: said coupler is made from fiberglass.

4. A soil nail, as claimed in claim 1, wherein said first and second outer members are made from fiberglass.

5. A method of placing a soil nail, said method comprising:

providing:

(i) a first outer member having a bore extending therethrough;

(ii) a second outer member having a bore extending therethrough;

(iii) a threaded coupler interconnecting adjacent ends of the outer members;

(iv) a threaded inner member placed through the bores of the first and second outer members wherein the outer members are threaded to receive the threaded inner member;

attaching a proximal end of the first outer member to a drilling machine;

attaching a drill tip to a distal end of the second outer member; and drilling said soil nail into the ground to a desired depth;

securing a bearing plate having an opening, and placing said bearing plate over the proximal end of the first outer member;

threading a first nut over the first outer member and against said bearing plate.

* * * * *